166-66 SR
7/17/84 OR 4,460,038

United States Patent [19]

Clamens

[11] Patent Number: 4,460,038

[45] Date of Patent: Jul. 17, 1984

[54] INSTALLATION FOR TESTING A WELL AND A PROCESS FOR USE THEREOF

[75] Inventor: Henri Clamens, Garderes, France

[73] Assignee: Societe Nationale Elf Aquitaine, France

[21] Appl. No.: 456,810

[22] Filed: Jan. 10, 1983

[30] Foreign Application Priority Data

Jan. 12, 1982 [FR] France ..... 82 00388

[51] Int. Cl.[3] ..... E21B 47/12

[52] U.S. Cl. ..... 166/66; 166/53; 417/359; 417/361; 73/304 R

[58] Field of Search ..... 166/53, 66, 64, 68, 166/72, 77, 103, 250, 107, 255, 113; 175/26, 48, 50, 103, 107; 417/359, 361; 73/304 R

[56] References Cited

U.S. PATENT DOCUMENTS

| | | | |
|---|---|---|---|
| 2,283,195 | 5/1942 | Farrell et al. | 417/359 |
| 2,326,556 | 8/1943 | Opsal | 175/103 |
| 2,347,589 | 4/1944 | Barstow | 166/66 |
| 2,376,878 | 5/1945 | Lehnhard, Jr. | 166/66 |
| 2,524,933 | 10/1950 | Silverman | 166/66 |
| 2,931,225 | 4/1960 | Pleuger | 73/300 |
| 2,997,120 | 8/1961 | Kendrick | 175/103 |
| 3,370,656 | 2/1968 | Grolet et al. | 175/103 |
| 3,502,037 | 3/1970 | Pickard | 166/122 |
| 3,800,870 | 4/1974 | Pitts, Jr. | 166/65 R |
| 4,284,943 | 8/1981 | Rowe | 166/53 X |

*Primary Examiner*—Ernest R. Purser
*Assistant Examiner*—Thuy M. Bui
*Attorney, Agent, or Firm*—Poms, Smith, Lande & Rose

[57] ABSTRACT

The invention provides an installation for testing a well by pumping by means of a submerged pump and a process for use thereof. The assembly 6 formed of an hydraulic pump and motor is carried by one end of a reinforced flexible tube 1 wound through a pulley 7 on a drum 3 actuated by the surface motor 8. . In the sheath of tube 1 are housed electric conductors 2 for supplying the motor of assembly 6. Sensors detecting the level of fluid in the well allow the submergence depth of the pump to be detected, the signals coming from this detection being able to be used to control motor 8 at the submergence depth ensuring a given flow rate. The invention applies to determination of the flow rate, pressure and temperature characteristics of a well.

11 Claims, 4 Drawing Figures

INSTALLATION FOR TESTING A WELL AND A PROCESS FOR USE THEREOF

BACKGROUND OF THE INVENTION

The present invention relates to an installation for testing a well by pumping by means of a submerged pump and a process for using same. Testing a well so as to determine the potential of a well, particularly insofar as its flow rate, pressure and temperature characteristics are concerned, usually takes place after removal of the heavy drilling equipment.

The cost of an installation for testing a well is covered by the value of the product extracted, during testing of a hydrocarbon well. In the case of a water well, hot or cold, economic considerations govern the choice of light and inexpensive equipment.

The present invention relates more particularly to an installation for testing a well by means of a submerged hydraulic pump actuated by an electric or hydraulic motor and placed at one end of a column plunged in the well. It is characterized by a flexible, reinforced tube, wound on a drum which is rotated by a surface motor and in that it comprises means for detecting the level of the fluid in the well.

The unit of the motor coupled to the hydraulic pump is carried by one end of the flexible tube and electric conductors are housed in the sheath of the flexible tube, said conductors serving either for supplying the motors, in the case of an electric motor, or for transmitting measurements in the case of a hydraulic motor. Such an installation presents several advantages. The equipment used may be gathered together on a single vehicle, such as as a semi-trailer and may be easly moved. With the flexible tube, the depth of the pump is adjustable, raising and lowering it are rapid. Since the position of the pump is easily detected, through the detecting means, the recorded flow rate, pressure and temperature data may be referred to the level at which the pump is working. Advantageously, the means for controlling the electric motor driving the drum may be coupled with means for detecting the depth of submergence of the pump for adjusting the position of the pump at levels providing a given flow rate.

The means for detecting the level of the flow rate or the dynamic pressure in the well may be formed by a pressure sensor placed for example close to the pump and therebelow. As a variation, these means may consist of electric wires incorporated in the wall of the flexible tube and integrated in electric circuits, whose bared ends are placed, staggered in height, on the external face of the wall of the flexible tube at a distance of about 10 m above the pump. The invention also relates to a process for using the installation for recording pressure variations at constant submergence, which is characterized in that the pump is lowered to a given depth under the level of the fluid in the well and said depth is varied by actuating the drum on the surface as a function of the level detection indications for maintaining a constant column height of the fluid above the pump.

Other features of the invention will appear from the description of preferred embodiments which follows, illustrated by the drawings in which.

Figure 1:
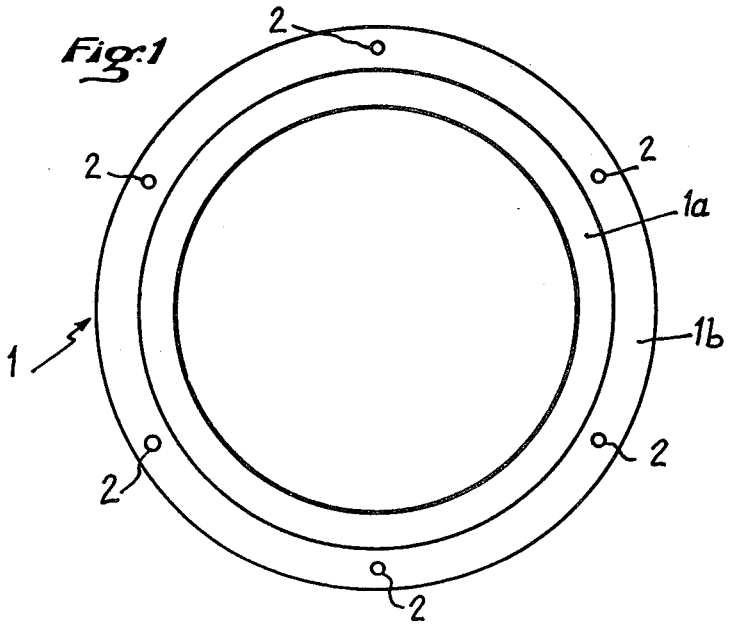
FIG. 1 shows the flexible tube in axial section.

A flexible reinforced tube 1, similar to the one used in the drilling process known under the same of flexoforage, is wound on a drum 3. The flexible tube, available in lengths varying from 100 to 1000 m and with inside diameters varying between 5.08 and 10.16 cm, is formed by layers of crossed metal wires 1*a* and an outer casing 1*b*, made for example from polyethylene, in which insulated electric conductors 2 are buried. One end 4 of tube 1, fixed in the axis of drum 3, ends in a metal piece through which, either the pumped product is removed in the case of a pump driven by an electric motor (FIG. 2), or pressurized fluid is injected for actuating a turbine coupled to the bottom pump (FIG. 3). Endpiece 4 is provided with mobile contacts for the electric connection of conductors 2 with a source of electric energy 10, such as a generating unit, by means of conductors 13 and 14.

The other end of flexible tube 1 carries by means of an endpiece 5 an assembly 6 comprising an electric motor coupled to an hydraulic pump lowered into a well shown schematically.

A pulley 7 having a groove matching the diameter of the flexible tube is movable vertically by means of two height adjustment devices 15 and 16, so that the flexible tube remains vertical with respect to the well. An electric motor 8 supplied by source 10 and rotatable at varying speeds, serves for rotating drum 3, through one or two gears 17 and a crown wheel 18, in the raising and lowering directions. A counter 9, measuring the length of the flexible tube as it unwinds, allows the depth of pump 6 to be continuously detected, possibly as a function of time, when it is coupled with a recorder.

A traversing device 19 allows the flexible tube 1 to wind correctly on drum 3.

Drum 3 can be locked with a hand brake 20 in the case of a malfunction of the rotation transmission system.

Figure 4:
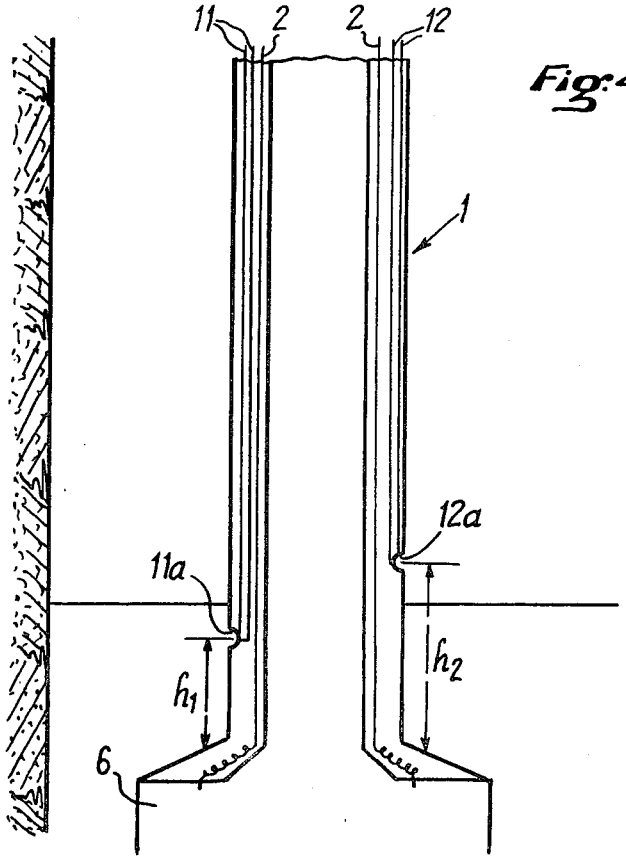
FIG. 4 shows level detecting means applied to the variation of FIG. 2.

Drum 3 with its flexible tube 1 wound up, pulley 7, motor 8 and the generating unit 10 may be advantageously placed on the platform of a half-trailer, as well as devices 19 and 20. The means for detecting the submergence level of the motor and pump 6 are shown in FIG. 4. Electric wires 11 and 12 incorporated in the sheath 1*b* of flexible tube 1 form at their bared ends 11*a* and 12*a* two contactors. These contactors are placed at a distance of about 10 m above pump 6 and are offset with respect to each other in height by a few centimeters or a few tens of centimeters. One is placed at height h1 above the pump and the other at height h2. The bared ends are in contact with the environment and the rise of the water level causes a current to pass between the two wires of each contactor.

With this device, the static or dynamic level of the fluid in the annular space of the well may be detected, this detection possibly resulting either in signalling by means of an indicator light or it may serve for controlling the motor of drum 8. In this latter case, the motor of the drum will be set to a given submergence depth and will maintain this depth as the level of the fluid in the well lowers.

Figure 2:
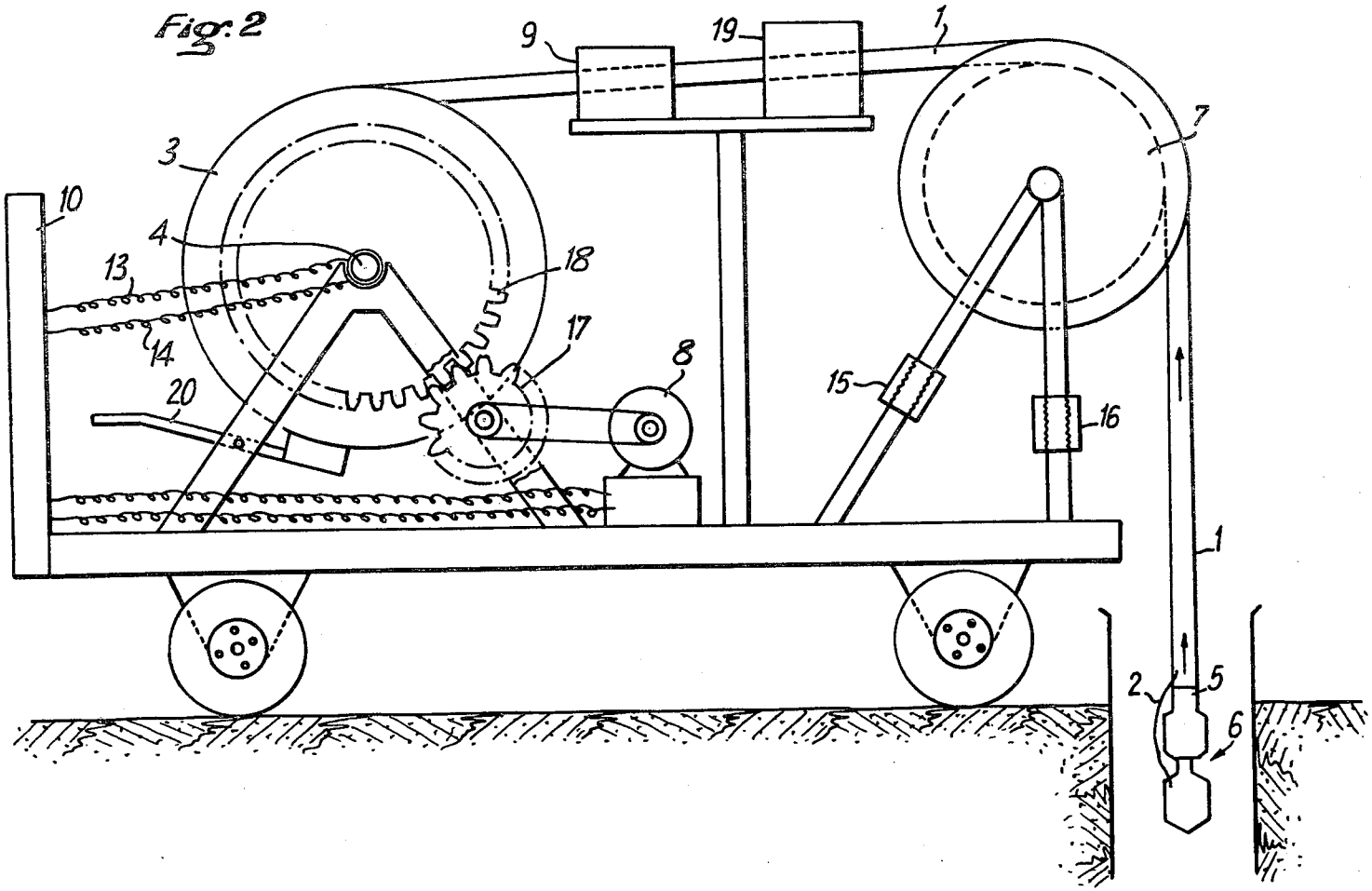
FIGS. 2 and 3 show two variations of the installation of the invention shown schematically.
Figure 3:
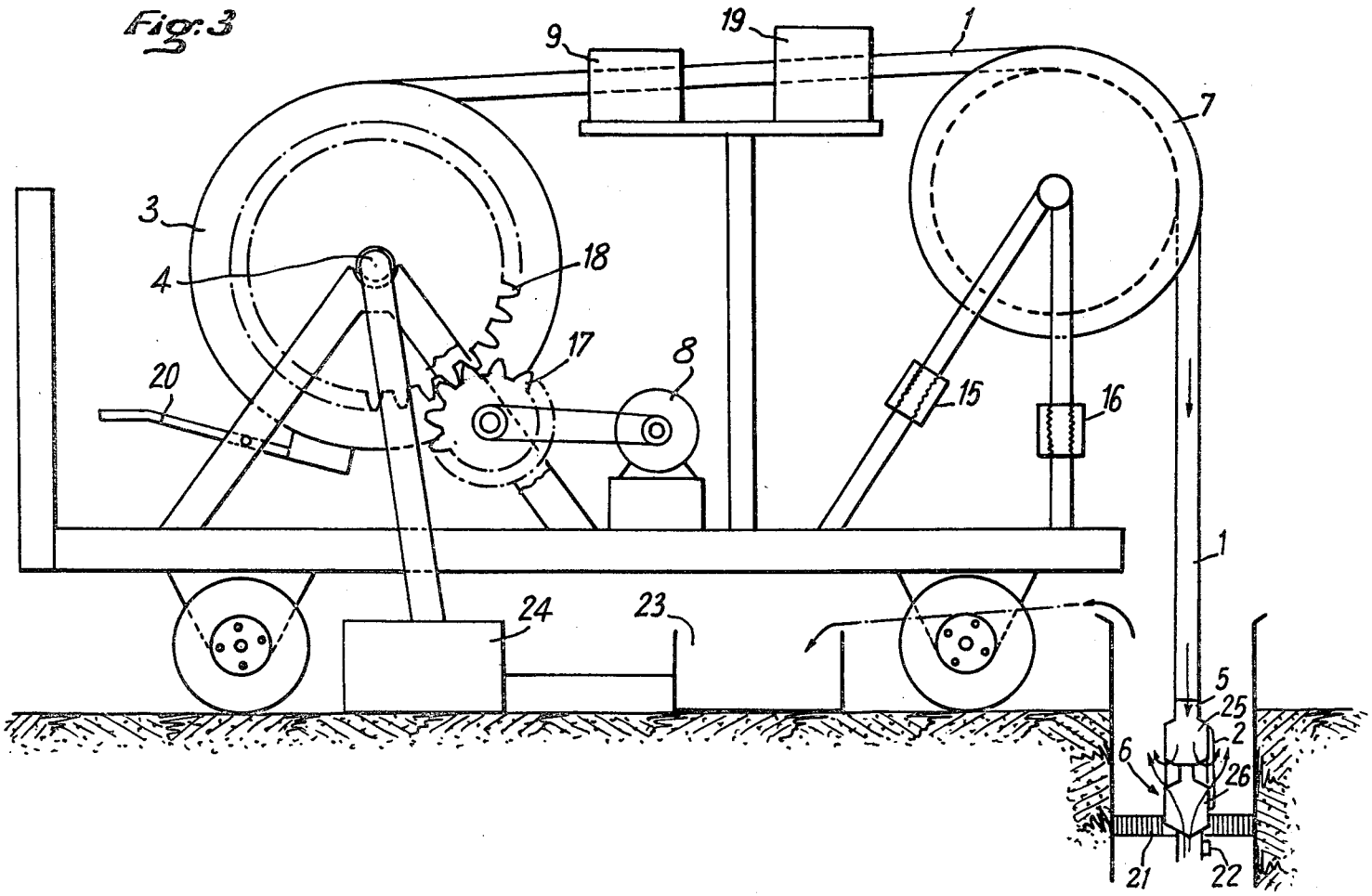

The operation of the installation shown in FIG. 2 is as follows. The half-trailer, loaded with the drum 3 with its motor 8 and pulley 7, is brought to the edge of the well, and the height adjustment devices 15 and 16 are adjusted so that the flexible tube 1 is straight above the well. The drum motor 8 is actuated and the motor-pump 6 assembly is lowered into the well. The lowering is stopped as soon as the submergence depth signalled by the detecting means, for example circuit 11 closed and circuit 12 open, is reached.

Counter 9 is calibrated as a function of this depth. The circuit of the pump motor is connected to supply source 10 through wires 13 and 14. When it is desired to measure the parameters of the constant flow well, the signals of detection of the submergence depth 11 and 12 are integrated in the control circuit of the motor of drum 8. As soon as the level of the fluid at the bottom of the well varies, the signals from circuits 11 and 12 serve as pulses for the control system of motor 8 which actuates drum 3 for raising or lowering pump 6. Thus, positioning of the pump is obtained at an adjustable depth, which allows operation at a constant flow rate and automatically adjustable.

Depending on the number of wires available in the flexible tube, it is possible to dispose several contacts, for example every meter, and thus to observe the lowering of the level of the well. The pump being in this case stationary. The submergence level detecting device allows the pump to be placed in an optimum position, since the submergence depth amount may be chosen at the time of incorporating in the flexible tube level detection means. By controlling the operation of the drum motor by means of signals coming from submergence level detection means and by correlating the pressure data of the well with recording of the depth reached by means of counter 9, the pressure drop curve at constant flow rate and the pressure rise curve after the pump has been stopped can be directly obtained.

In the case of the installation shown in the variation of FIG. 3, the hydraulic pump 26 plunged in the well is actuated by hydraulic turbine 25. The end 4 of flexible tube 1 is connected by a delivery pipe to a surface pump 24. The other end of flexible tube 1 carries by means of endpiece 5 an assembly 6 formed of turbine 25 located above pump 26, the annular space being closed by a device 21, whose positioning is ensured either by the pressure difference between the zone above device 21 and the zone situated below this device, or by the pressure reigning inside endpiece 5, through a small tube (not shown), connecting endpiece 5 to device 21. The conductors 2 incorporated in the flexible tube are permanently connected to sensors 22 situated under device 21 and allowing the pressure and temperature to be known at this position.

The operation of this installation is as follows. The half-trailer, loaded with the above-mentioned equipment, is brought to the edge of the well and devices 15 and 16 are adjusted so that the flexible tube 1 is straight above the well.

Motor 8 is actuated to lower the flexible tube carrying at its end the assembly 6 formed of turbine 25 and pump 26, sensors 22 and the sealing device 21. Lowering is stopped when sensor 22 indicates the chosen submergence and the surface pump 24 is started up, which sucks up from tank 23 previously filled with water and discharges this year into the flexible tube 1 through endpiece 4. The device 21 remains on the surface of the liquid in the well due to the pressure of water pumped by pump 24 through flexible tube 1 in order to drive the turbine 25. Water leaving turbine 25 flows through the annulus of the casing. Liquid pumped from the well by suction of pump 26 also flows through the same casing annulus and the pressure of this liquid assists in causing the device 21 to remain in sealing position on the surface of the liquid. Besides fluid beneath the device 21 is at low pressure so that such low pressure also contributes to the positioning of the device at the liquid level and to sealing of the annulus. The flow of liquid coming from the bottom of the well through the pumping action is removed through the annular space and may be directed either to tank 23 or to a place of use of storage.

The ratio of the total flow rate to the delivery rate of the surface pump is preferably of the order of 3 to 5, depending on the powers used. To change the position of assembly 6, it is necessary to stop pumping for a few seconds.

The invention is not limited to the embodiment described above, variations may be made thereto without departing from the scope and spirit of the invention.

I claim:

1. An installation for testing a well by means of a pump submerged in the well and actuated by an electric or hydraulic motor characterized in that a reinforced flexible tube (1) carries said pump in said well, a drum (3) is provided at the surface and about which the tube is wound, a motor means (8) is provided for rotating said drum to lower and to vary the submergence of the pump, and means (11*a*, 12*a*, 22) are associated with the flexible tube adjacent the pump for detecting the level of the fluid above the pump in the well.

2. The installation according to claim 1, including an electric motor, coupled to said pump, is carried by the end of the flexible tube 1, and electric conductors (2) for supplying the motor are housed in the sheath (1*b*) of the flexible tube.

3. The installation according to claim 1, including:

means for controlling motor means (8) driving the drum (3) for adjusting the submergence depth of the pump to a fluid level above the pump for ensuring a given flow rate, said means for detecting the level of the fluid (11*a*, 12*a*) being coupled to the motor controlling means, 4. The installation according to claim 1, characterized in that said pump is a hydraulic pump (26), the end of the flexible tube (1) carries a turbine (25), coupled to said hydraulic pump (26), and a device (21) for sealing the annular space between said pump 26 and the internal wall of the well.

5. The installation according to claim 1, characterized in that the fluid level detection means are formed by a pressure sensor means (22).

6. The installation according to claim 1, characterized in that the pressure sensor means is accompanied by a temperature sensor means.

7. The installation according to claim 1, characterized in that the fluid level detection means includes electric wires (11, 12) incorporated in the sheath (1*b*) of the flexible tube (1), said wires having bared ends (11*a*, 12*a*) placed, offset in height, on the external face of the wall of the flexible tube at selected distances above the pump.

8. In a process for recording pressure variations in a well at a constant flow rate in which a submerged pump in a casing is actuated by an electric or hydraulic motor, and carried at one end of a flexible tube having fluid level sensing detector means adjacent said pump, said tube being wound about a rotatable drum at the surface above the well including the steps of:

lowering the pump by rotating the drum to a selected depth under the level of the fluid in the well;

sensing changes in fluid level relative to the pump location to maintain a constant head of fluid above the pump, transmitting said sensed fluid level changes to said rotatable drum for causing rotation of said drum for raising or lowering said pump to maintain a constant depth of submergence and a stable flow rate of the pump.

9. A method as stated in claim 8 including the steps of:

transferring by a surface pump part of the fluid extracted from the well and discharging the part of the fluid under pressure into the flexible tube to cause the turbine in the submerged pump to rotate.

10. A method according to claim 8 including the step of:

sealing the annular space between the submerged pump and the casing.

11. A method according to claim 10 including the step of:

controlling sealing of the annular space between the pump and the casing by actuating said surface pump.

* * * * *